US006904663B2

(12) United States Patent
Willett et al.

(10) Patent No.: US 6,904,663 B2
(45) Date of Patent: Jun. 14, 2005

(54) METHOD FOR MANUFACTURING A GOLF CLUB FACE

(75) Inventors: Kraig A. Willett, Fallbrook, CA (US); Stephen A. Kraus, San Diego, CA (US); Todd P. Beach, San Diego, CA (US); Joseph H. Hoffman, Carlsbad, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 273 days.

(21) Appl. No.: 10/288,551

(22) Filed: Nov. 4, 2002

(65) Prior Publication Data

US 2004/0083596 A1 May 6, 2004

(51) Int. Cl.[7] ..... B23P 13/04
(52) U.S. Cl. ..... 29/557; 473/342
(58) Field of Search ..... 29/557, 558; 473/331, 473/342, 409

(56) References Cited

U.S. PATENT DOCUMENTS

| | | | | | |
|---|---|---|---|---|---|
| 5,474,296 | A | | 12/1995 | Schmidt et al. | 273/167 |
| 5,527,034 | A | | 6/1996 | Ashcraft et al. | 473/330 |
| 5,611,742 | A | * | 3/1997 | Kobayashi | 473/331 |
| 5,755,627 | A | | 5/1998 | Yamazaki et al. | 473/345 |
| 5,788,584 | A | | 8/1998 | Parente et al. | 473/290 |
| 5,830,084 | A | | 11/1998 | Kosmatka | 473/349 |
| 5,868,635 | A | * | 2/1999 | Aizawa et al. | 473/409 |
| 5,954,596 | A | | 9/1999 | Noble et al. | 473/346 |
| 5,961,394 | A | * | 10/1999 | Minabe | 473/331 |
| 6,193,614 | B1 | | 2/2001 | Sasamoto et al. | 473/329 |
| 6,200,685 | B1 | | 3/2001 | Davidson | 428/472.1 |
| 6,248,025 | B1 | | 6/2001 | Murphy et al. | 473/324 |
| 6,368,234 | B1 | * | 4/2002 | Galloway | 473/349 |
| 6,435,979 | B1 | | 8/2002 | Mounfield, Jr. | 473/324 |
| 6,440,011 | B1 | | 8/2002 | Hocknell et al. | 473/342 |
| 6,508,722 | B1 | * | 1/2003 | McCabe et al. | 473/342 |
| 6,638,182 | B2 | * | 10/2003 | Kosmatka | 473/331 |
| 6,659,885 | B1 | * | 12/2003 | Knuth | 473/342 |
| 6,800,038 | B2 | * | 10/2004 | Willett et al. | 473/329 |
| 2002/0065146 | A1 | | 5/2002 | Kusumoto et al. | 473/345 |
| 2002/0098908 | A1 | | 7/2002 | James et al. | 473/324 |
| 2003/0083148 | A1 | * | 5/2003 | Willett et al. | 473/329 |
| 2003/0092505 | A1 | | 5/2003 | Liou | 473/345 |
| 2003/0139227 | A1 | | 7/2003 | Sugimoto | 473/342 |
| 2004/0082404 | A1 | * | 4/2004 | Willett et al. | 473/342 |
| 2004/0099538 | A1 | * | 5/2004 | Chao et al. | 205/705 |

FOREIGN PATENT DOCUMENTS

| | | |
|---|---|---|
| GB | 2 338 903 | 1/2000 |
| JP | 09-299519 | 11/1997 |
| JP | 10-155943 | 6/1998 |

* cited by examiner

*Primary Examiner*—David P. Bryant
(74) *Attorney, Agent, or Firm*—Sheppard, Mullin, Richter & Hampton LLP

(57) ABSTRACT

A method of manufacturing a face plate for a golf club head is presented to provide face having substantial thickness variation for enhanced performance. The method includes the steps of providing a rolled sheet of metal material having an initial thickness and forming a blank having a prescribed outer shape from the material. The method also includes machining a second side of the blank such that the resulting face plate has a variable thickness. The machining is such that the plate has a first thickness less than or equal to the initial thickness, a second thickness less than the first thickness and a third thickness less than the second thickness. The machining is performed over a substantial portion of the surface area of the second side. Either a CNC lathe or milling machine may be used; however, for an axisymmetric face thickness a CNC lathe is preferred and for an asymmetric face thickness a CNC end mill is preferred. The club head may be a wood-type or iron, and titanium or steel alloys may be used.

30 Claims, 5 Drawing Sheets

FIG. 4
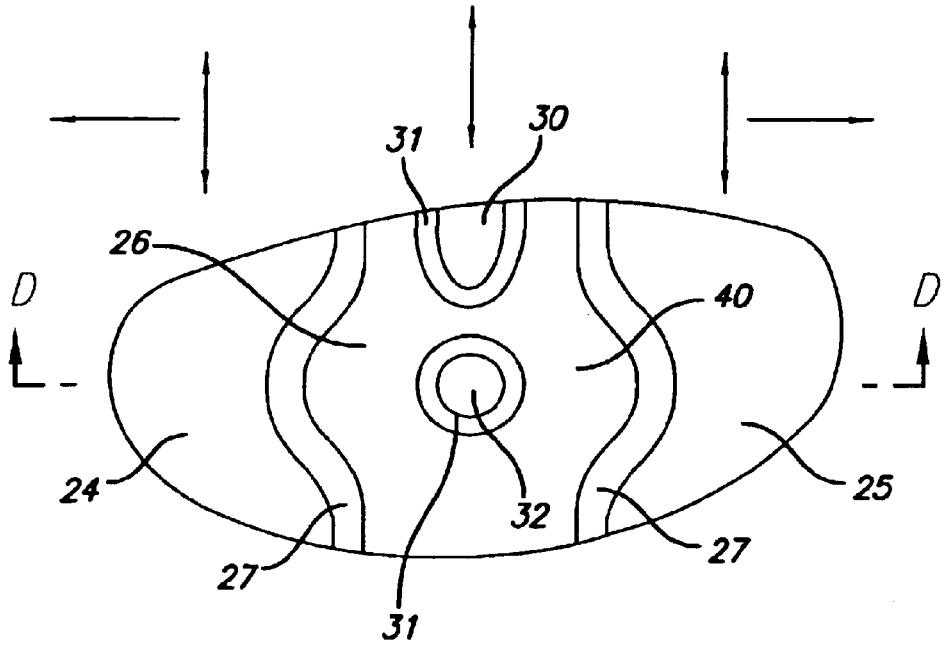
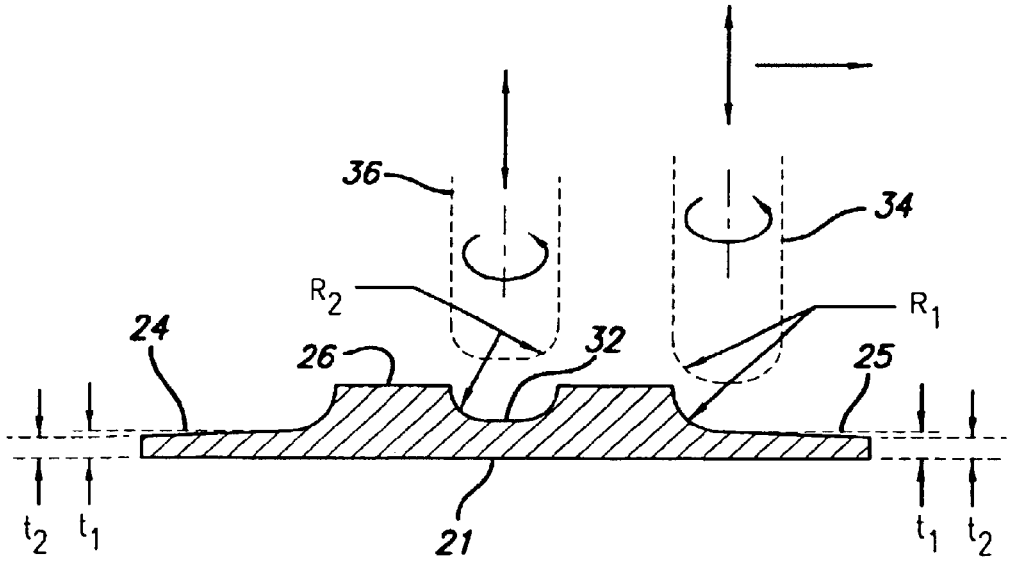
FIG. 5

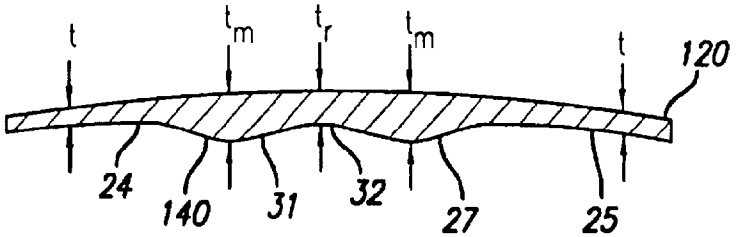
FIG. 6A
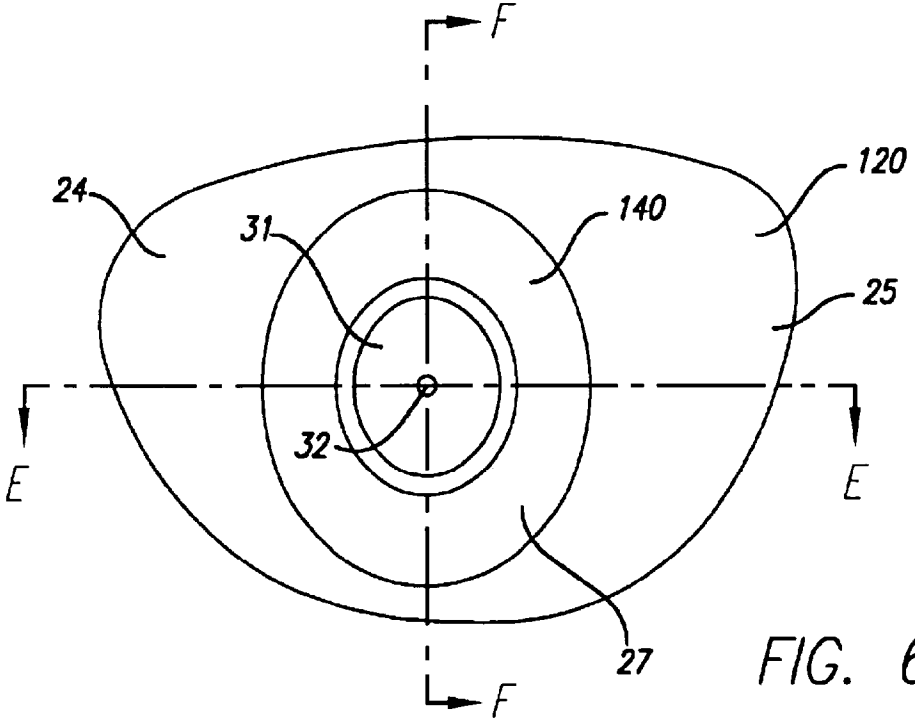
FIG. 6
FIG. 6B
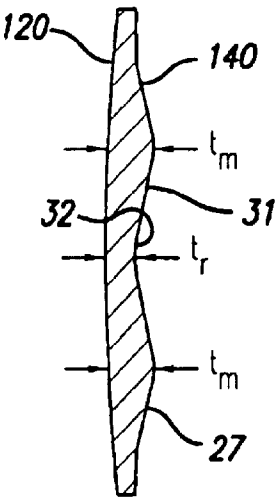

METHOD FOR MANUFACTURING A GOLF CLUB FACE

BACKGROUND OF THE INVENTION

The present invention relates generally to golf club heads and, more particularly, to golf club heads having a face plate of variable thickness.

Modern golf clubs have typically been classified as either woods, irons or putters. The term "wood" is an historical term that is still commonly used, even for golf clubs that are constructed of steel, titanium, fiberglass and other more exotic materials, to name a few. The woods are now often referred to as "metal woods." The term "iron" is also an historical term that is still commonly used, even though those clubs are not typically constructed of iron, but are rather constructed of many of the same materials used to construct "woods."

Many advancements have been achieved, particularly over the past couple of decades, to make it easier to hit longer and straighter shots with woods and irons. In general, golf clubs are now designed to be more forgiving, so that shots that are struck less than perfectly will still have fairly consistent distance and directional control. Moreover, club heads now are commonly constructed of combinations of materials, to attempt to optimize the ball flight desired by a particular type of player.

One particular improvement that relates especially to metal woods is the use of lighter and stronger metals, such as titanium. A significant number of the premium metal woods, especially drivers, are now constructed primarily using titanium. The use of titanium and other lightweight, strong metals has made it possible to create metal woods of ever increasing sizes. The size of metal woods, especially drivers, is often referred to in terms of volume. For instance, current drivers may have a volume of 300 cubic centimeters (cc) or more. Oversized metal woods generally provide a larger sweet spot and a higher inertia, which provides greater forgiveness than a golf club having a conventional head size.

One advantage derived from the use of lighter and stronger metals is the ability to make thinner walls, including the striking face and all other walls of the metal wood club. This allows designers more leeway in the positioning of weights. For instance, to promote forgiveness, designers may move the weight to the periphery of the metal wood head and backwards from the face. As mentioned above, such weighting generally results in a higher inertia, which results in less twisting due to off-center hits.

There are limitations on how large a golf club head can be manufactured, which is a function of several parameters, including the material, the weight of the club head and the strength of the club head. Additionally, to avoid increasing weight, as the head becomes larger, the thickness of the walls must be made thinner, including the face plate. As the face plate becomes thinner, it has a tendency to deflect more at impact, and thereby has the potential to impart more energy to the ball. This phenomenon is generally referred to as the "trampoline effect." A properly constructed club with a thin face can therefore impart a higher initial velocity to a golf ball than a club with a rigid face. Because initial velocity is an important component in determining how far a golf ball travels, this is very important to golfers.

It is appreciated by those of skill in the art that the initial velocity imparted to a golf ball by a thin-faced metal wood varies depending on the location of the point of impact of a golf ball on the striking face. Each face plate has what is referred to as a "sweet spot." Generally, balls struck in the sweet spot will have a higher rebound velocity. Many factors contribute to the location and size of the sweet spot, including the location of the center of gravity (CG) and the shape and thickness of the face plate.

Manufacturers of metal wood golf club heads have more recently attempted to manipulate the performance of their club heads by designing face plates of variable thicknesses. Because of the use of lightweight materials such as titanium for the face plate, a problem arises in the stresses that are transmitted to the face-crown and face-sole junctions of the club head upon impact with the golf ball. One prior solution has been to provide a reinforced periphery of the face plate in order to withstand the repeated impacts. The manufacture of face plates has typically been accomplished by forging a metal, such as a titanium alloy, to achieve the face thickness variation.

Another approach to reduce these stresses at impact is to use one or more ribs extending substantially from the crown to the sole vertically across the face, and in some instances extending from the toe to the heel horizontally across the face. Because the largest stresses are located at the impact point, usually at or substantially near the sweet spot, the center of the face is also thickened and is at least as thick as the ribbed portions. However, these club heads fail to ultimately provide much forgiveness to off-center hits for all but the most expert golfers. The variable face thickness design and the use of titanium face inserts have also recently been applied to iron golf club heads with similar disadvantages and limitations. Well known casting and forging techniques have typically been employed to achieve the variable face thickness designs for irons.

It should, therefore, be appreciated that there exists a need for an improved method of manufacturing golf club face plates that exhibit greater forgiveness across a substantial portion of the face plate while continuing to impart higher initial velocity having a variable thickness. The present invention fulfills that need and others.

SUMMARY OF THE INVENTION

The invention provides a method of manufacturing a golf club face plate having substantial thickness variation for enhanced performance. The method includes the steps of providing a rolled sheet of metal material having an initial thickness and forming a blank having a prescribed outer shape from the material. The method also includes machining a second side of the blank such that the resulting face plate has a variable thickness. The variable thickness includes a first thickness less than or equal to the initial thickness, a second thickness less than the first thickness and a third thickness less than the second thickness. The machining is performed over a substantial portion of the surface area of the second side.

An advantage of the rolled sheet material is that it can have a very fine, directional grain microstructure that results in improved strength and ductility compared to other materials and manufacturing methods Either a CNC lathe or milling machine may be used; however, for an axisymmetric face thickness a CNC lathe is preferred and for an asymmetric face thickness a CNC end mill is preferred. The club head may be a wood-type or iron, and titanium or steel alloys may be used.

In a detailed aspect of a preferred embodiment, at least 60% of the surface area of the second side is machined, and the resulting face thickness variation may be axisymmetric or asymmetric.

In another detailed aspect of a preferred embodiment, a bulge and a roll is formed on a first side of the blank.

In yet another detailed aspect of a preferred embodiment, at least 15% of the material of the blank is removed. Additional thickness and/or different transition regions may be machined, according to the face thickness design desired.

For purposes of summarizing the invention and the advantages achieved over the prior art, certain advantages of the invention have been described herein above. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment(s) disclosed.

BRIEF DESCRIPTION OF THE DRAWINGS

Embodiments of the present invention will now be described, by way of example only, with reference to the following drawings in which:

FIG. 4 is a rear view of the plate of FIG. 3 showing the preferred directions (arrows) of the cutters during the machining process.

FIG. 5 is a cross-section taken along line D—D of FIG. 4 showing a first and second (in phantom) formed cutter to achieve the desired radii of the web transitions of the face thickness.

FIG. 6 is a rear view of a face plate formed in an alternative method of the present invention.

FIG. 6A is a longitudinal cross-section view taken along line E—E of FIG. 6.

FIG. 6B is a lateral cross-section view taken along line F—F of FIG. 6.

DETAILED DESCRIPTION OF THE PREFERRED EMBODIMENTS

Figure 1:
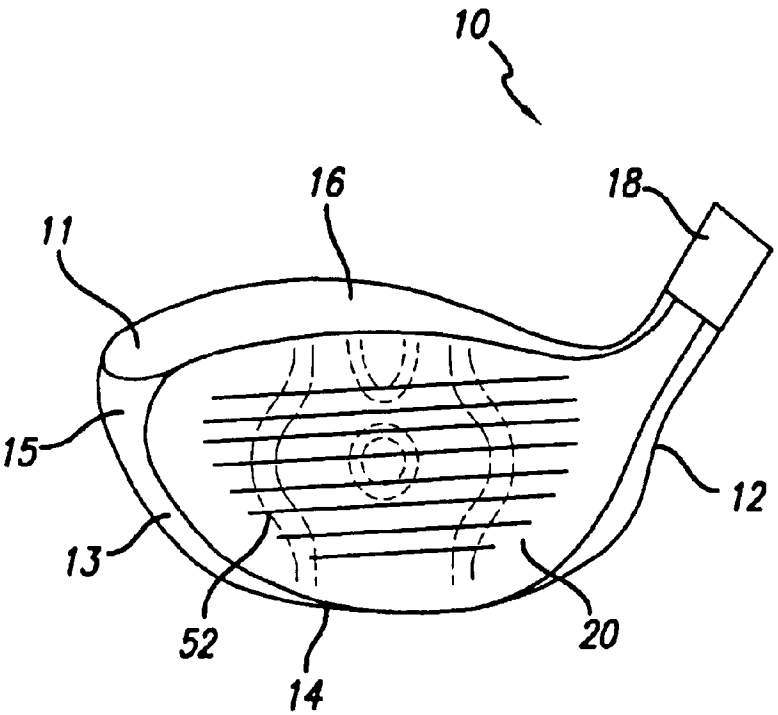
FIG. 1 is a front view of a wood-type club head having a face thickness (in phantom) provided by a preferred method of the present invention.

The drawings depict preferred embodiments of face plates achieved by methods of the present invention, the golf club face plates being for different types of golf club heads. With reference to FIG. 1, a club head 10 is shown that is similar to many metal wood club heads that are known in the art. Club heads within the scope of the invention are not necessarily limited to the shapes depicted. The club head 10 comprises a hollow metallic body 11 and a face plate 20. The body comprises a heel portion 12, a toe portion 13, a sole portion 14, skirt or side portion 15 and a crown portion 16 that cooperate to define a periphery 17 for an opening (see FIG. 3) for the face plate. The club head is normally connected to a shaft (not shown) by a hosel 18 that is integrally formed with the body.

Preferably, the body and/or face plate is constructed of steel, titanium or alloys thereof, but alternatively the body may comprise a composite or metal matrix material. The face plate may be constructed of any rolled sheet material that can be machined, and preferably the material has a density of at least 4 g/cc. Prior face plates of rolled sheet material, such as Ti-6AL-4V, have either been constant in thickness or had minimal material removed to achieve relatively small face thickness variation.

Rolled sheets of high strength titanium alloy, such as SP-700® by NKK Corporation of Japan, have previously been thought to be too expensive to waste material by substantial machining of it to remove material to achieve significant thickness variation, as in the present invention. An advantage of the rolled sheet material is that it can have a very fine, directional grain microstructure that results in improved strength and ductility compared to other materials and manufacturing methods. Applicants have found that the combination of rolled sheet material and machining to be a cost effective and reliable way to produce the quality of the face thickness desired. In addition to the preferred face thickness designs presented herein, those skilled in the art will appreciate that further designs resulting in three or more thickness zones may be achieved using the method of the present invention.

Figure 2:
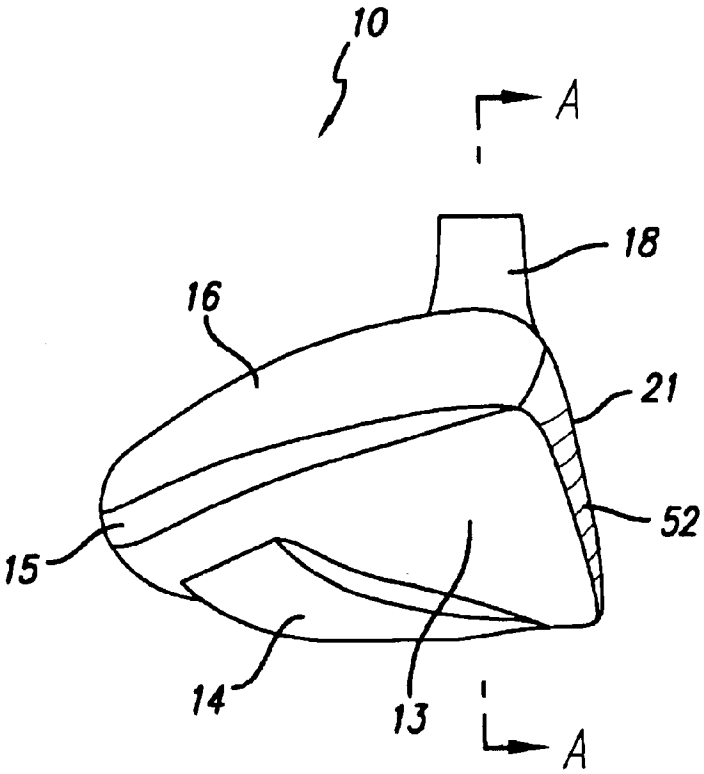
FIG. 2 is a toe end view of the club head of FIG. 1.

Referring to FIGS. 1 and 2, the club head is preferably manufactured such that the body 11, including the heel portion 12, toe portion 13, sole portion 14, side portion 15, crown portion 16 and hosel 18 are integrally formed, and the face plate 20 having a striking face 21 is fixedly attached to the opening periphery 17 by means known in the art. However, the various portions of the preferred body may be separately molded, cast, forged or otherwise manufactured by means known in the art, and fixedly attached to form the body by means known in the art. An initial outer shape for the face plate may be formed by stamping a rolled sheet of metal material.

Figure 3B:
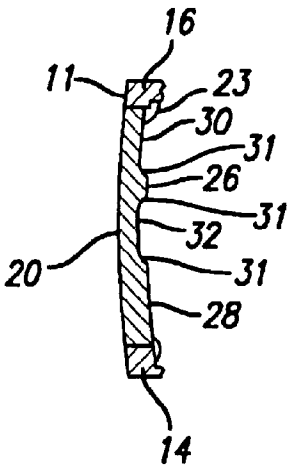
FIG. 3B is a cross-sectional view taken along line C—C of FIG. 3.

The machined face plate 20 is welded along its periphery, and at the rear the weld bead 23 is visible. As shown in FIGS. 3–3B, heel and toe zones 24, 25 of the face plate have a similar thickness t that is preferably less than the adjacent thickness of the body 11 at the front opening periphery 17. A central vertical zone 26 has a maximum thickness $t_m$ of the face plate, with transition thickness regions 27 formed between the heel and central zones and the toe and central zones. A lower region 28 of the central vertical zone extends toward the sole portion 14, and upper segments 29 extend toward the crown portion 16. The face plate has an asymmetric face thickness about a longitudinal or heel to toe axis.

Between the upper segments is a recess 30 that has a thickness $t_r$ less than the maximum thickness $t_m$ but preferably greater than the thickness t of the heel and toe zones 24, 25. A transition thickness region 31 is formed between the upper segments' thickness $t_m$ and the recess thickness $t_r$. In addition for the present invention, at approximately the center of the face plate 20 is a recess 32 that preferably has a thickness $t_r$ substantially the same as the upper recess and with a similar transition region 31 between the thickness of the central recess and the thickness of the vertical zone 26. In alternative embodiments the thickness at the toe zone may be different from the thickness at the heel zone, and the thickness at the upper recess may be different than the thickness at the central recess, as desired.

Preferably, the central recess 32 and transition 31 extend a distance between 20% and 50% of the width of the vertical zone 26 and transitions 27 measured in a toe to heel direction. In the preferred embodiment of FIG. 3, the toe and heel zones 25, 24 of the rear surface 22 each have a thickness t less than 2.5 mm and the thickness of the vertical zone is at least 3.0 mm. The reduced thickness $t_r$ of each of the central recess and upper recess 30 is at least about 0.5 mm less than the thickness $t_m$ of the vertical zone. Preferably, the thicknesses t, $t_r$, $t_m$ are 1.6 mm to 2.4 mm, 2.2 mm to 3.5 mm and 3.2 mm to 4.5 mm, respectively. More preferably, the thickness ranges are 2.2 mm to 2.4 mm, 3.0 mm to 3.2 mm and 3.5 mm to 3.7 mm, respectively. Generally, it is preferred that the heel and toe zones have a minimum thickness at least 1 mm less than the maximum thickness of the vertical zone.

Figure 3A:
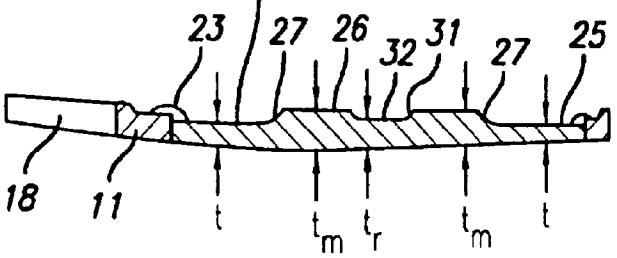
FIG. 3A is a cross-sectional view taken along line B—B of FIG. 3.
Figure 3:
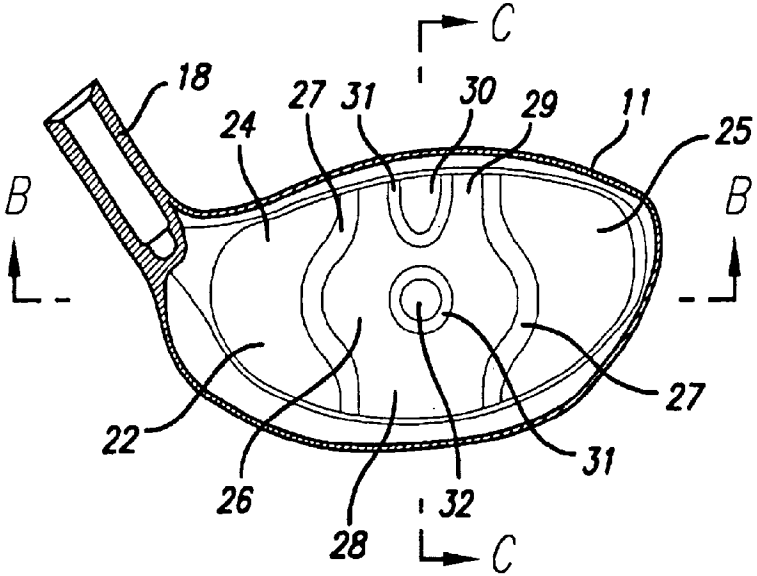
FIG. 3 is a cross-sectional view taken along line A—A of FIG. 2 and showing a rear of the face plate.

As shown in FIGS. 3A and 3B, the transition regions 27, 31 comprise a web transition having a generally concave cross-section. That is, the cross-section preferably comprises a radiused surface for the web transition between the vertical zone 26 and the recesses 30, 32 and the heel and toe zones 24, 25. In a preferred method, a CNC end mill 42 (FIG. 7) is used having a profiled cutter chosen to minimize the number of passes required to provide the desired thickness variation of the face plate. The face plate is placed in a fixture 43, positioned using locating pins 45 and held in place using adjustable clamps 47. For a lathe, adjustable jaws are used to hold the piece in place during machining. The rotating cutter moves in X, Y and Z axes according to the programmed face design.

Referring to FIG. 5, a single formed cutter 34 having a radius $R_1$ may be used for all the transition regions 27, 31, although it is preferred to use a second cutter 36 (shown in phantom) having a radius $R_2$ different than the first cutter for the transition region 31. The second radius $R_2$ is preferably smaller to accommodate the smaller areas covered by the recesses 30, 32. Of course another smaller radius cutter may be used for either the upper recess 30 or central recess 32; and/or another different radius cutter may be used for the toe zone 25 than the heel zone 24, as desired. It is most preferable to use only one or two different cutters to simplify and speed up the manufacturing process.

FIG. 4 shows arrows indicating preferred paths taken by the cutters. At the toe and heel zones, the cutter 34 may be calibrated from the center of the face plate 20 and move first in a top to bottom direction and second in an outward direction to the heel or toe ends of the plate. Preferably, the cutter moves inward from the heel or toe end toward the center of the face plate. The smaller radius cutter 36 may form the upper recess 30 by moving from the top edge toward the center of the face plate, or, alternatively, by moving from adjacent a central region 40 comprising the central recess toward the top edge. As shown in FIG. 5, the central recess 32 may be formed by the smaller radius cutter by a vertical or up and down motion to obtain the desired thickness $t_r$.

The CNC end mill 42 using formed cutters advantageously allows production of the desired face thickness in 2 to 3 passes at each of the toe and heel zones (4 to 6 passes), a pass to create each of the upper and central recesses (2 passes); thus, a face plate 20 may be produced in 6 to 8 passes or actions by the machine. The total number of passes or actions required is determined by the selected size/shape of the cutter(s) and the face thickness design.

Figure 8:
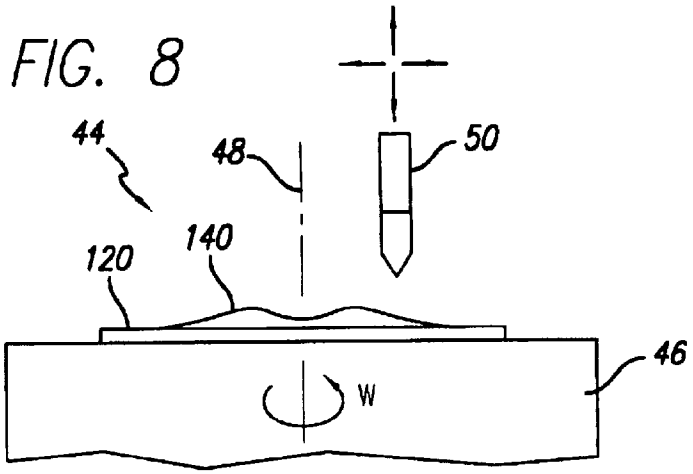
FIGS. 8 and 9 are exemplary views of an alternative method of the present invention utilizing a CNC lathe to create face thickness variation and bulge and roll, respectively, for a face plate.
Figure 9:
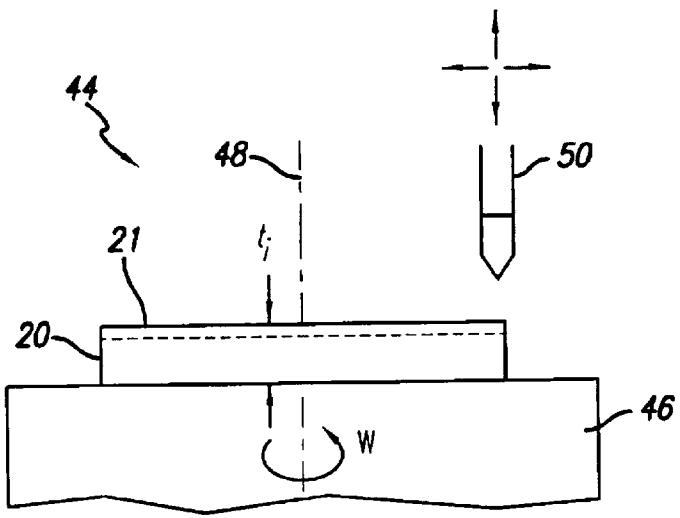
Figure 7:
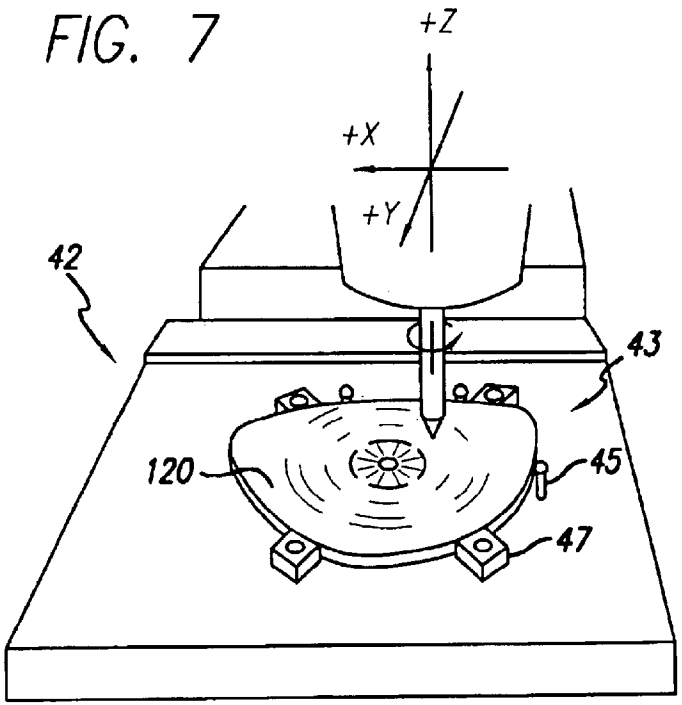
FIG. 7 is a front perspective view of a CNC milling machine in a preferred method of the present invention.

A face plate 120 shown in FIGS. 6–6B comprises a face thickness that varies symmetrically about the longitudinal as well as lateral (top to bottom) axis (lines E—E and F—F, respectively). A central recess 32 is located in a central region 140. This axisymmetric shape may be achieved using an end mill-type CNC machine 42, as represented in FIG. 7; however, the preferred method utilizes a CNC lathe 44 wherein a spindle 46 rotates and turns the face plate 120 about a central axis 48, as represented in FIGS. 8 and 9. One or more cutting tools 50 move according to the programmed design to provide the desired face thickness.

By computer controlling the relative movement of a cutter in the three axes, using techniques well known to those skilled in the art, a taper may be provided at the toe and heel zones, from a thickness $t_1$ adjacent the transition 27 to a smaller thickness $t_2$ at heel and toe ends of the face plate (see FIG. 5). However, the limited incremental or stepwise control of the end mill cutter position typically results in a visible step formed by each pass of the cutting tool across the surface. The CNC lathe method described for FIGS. 6–6B, however, provides more continuously variable thickness or surface taper that may be desired on the rear surface of the face plate. Of course, it is understood that the machining methods of the present invention for manufacturing a golf club face may be performed without CNC machining, although CNC machining is preferred for a large production run.

In the method of the present invention, the front striking face 21 may be provided with grooves, dimples or any combination thereof to form a scoreline pattern 52 (see FIG. 1) before or after the face thickness variation is provided. Similarly, a bulge radius and a roll radius may be provided on the face plate before or after the face thickness variation. FIG. 9 illustrates one method wherein the bulge and roll are machined on the striking face 21 prior to the face thickness of the rear surface. The center of the face plate maintains substantially the same initial thickness $t_1$ as the original rolled sheet of material. Alternatively, a stamping or forming process may be employed to achieve the desired bulge and roll radii desirable for wood-type golf club heads.

In one preferred method, the bulge and roll are formed on the face plate at a feed rate or cutter advancement of about 0.1 mm per revolution (mm/rev). Preferably, for Ti-6AL-4V material for the face plate the spindle 46 rotates between about 180 to 450 revolutions per minute (RPM), and for SP-700® material the spindle 46 rotates between about 180 to 400 RPM, with the RPM increasing as the cutter 50 advances toward the center of the face plate 20.

To machine the face thickness variation, a blind hole is first drilled to remove some material at the center of the face. A rough turning is performed to remove a preliminary amount of material using the feed rate and rotations described above for bulge and roll formation. A more precise, fine turning is performed using a preferred feed rate of about 0.14 mm/rev. For Ti-6AL-4V and SP-700® materials the turn or spin rates $\omega$ are 180 to 500 RPM and 180 to 450 RPM, respectively. It takes a total of about 6 minutes to provide the face thickness variation on a face plate 120 of SP-700® material.

Alternatively, the center recess 32 and central region 140 of increased thickness may be formed by first drilling at about 0.21 mm/rev with a cutting tool having an outer diameter of 17.0 mm and having a spindle speed ω of about 700 RPM. Rough turning is performed at about 0.4 to 2.5 mm/rev as the spindle 46 rotates from 100 to 600 RPM, with a Z-axis feed depth or vertical displacement of between 0.4 to 1.0 mm. The cutting tool is preferably a 60 deg triangle tip, known to those skilled in the art. The fine turning is performed at about 0.06 to 0.6 mm/rev with a spindle speed ω of about 200 to 2000 RPM (outside to center speed). The Z-axis feed depth is about 0.1 mm and the cutting tool preferably has a 35 deg rhombus tip. For lubrication an oil such as Castrol® B7 may be used.

One aspect of the method of the present invention is the amount of material removed by the machining. At least 60% of the original surface area is machined to varying depths or thickness. Preferably, machining is performed over at least 70% of the surface area, and more preferably machining is performed over at least 80%. In one embodiment, over 90% of the rear surface of the face plate is machined, and 100%—or the entirety—of the rear surface may be machined. The volume of material removed from the initial shape of the plate that is formed from the rolled sheet is at least 15% and preferably at least 25%. In one preferred embodiment, over 40% of material is removed.

The embodiments described in detail herein are merely illustrative and the present invention may be readily embodied, for example, to provide club heads having hybrid constructions utilizing, e.g., laminations of metal and composite materials. The club heads may be hollow or filled and may comprise unitary or multi-piece bodies. Advantageously, the method of the present invention may be employed for a face plate for a metal wood to achieve COR values greater than about 0.80 across a greater portion of the striking surface than conventional club heads; e.g., increasing a sweet spot for a relatively "hot" metal wood. And, while the preferred methods are described in detail for face plates for metal woods, i.e., drivers and fairway woods, it will be appreciated that the present invention may be utilized to form face plates for irons as well.

Although the invention has been disclosed in detail with reference only to the preferred embodiments, those skilled in the art will appreciate that additional methods for manufacturing face plates for golf club heads can be included without departing from the scope of the invention. Accordingly, the invention is defined only by the claims set forth below.

We claim:

1. A method for manufacturing a face plate for a golf club head, comprising:

providing a rolled sheet of metal material having an initial thickness;

forming a blank having a prescribed outer shape from the material, the blank having first and second sides; and machining the second side such that the resulting face plate has a first thickness less than or equal to the initial thickness, a second thickness less than the first thickness and a third thickness less than the second thickness;

wherein machining is performed over a substantial portion of the surface area of the second side, and at least 25% of the initial volume of material is removed during machining.

2. A method as defined in claim 1, wherein the machining is performed over at least 60% of the surface area of the second side.

3. A method as defined in claim 1, further comprising machining the second side such that the resulting face plate has a fourth thickness, the fourth thickness less than the first, second and third thicknesses.

4. A method as defined in claim 1, further comprising forming a web transition region between the first and second thicknesses.

5. A method as defined in claim 1, further comprising forming a continuously variable transition region between the first and second thicknesses.

6. A method for manufacturing a face plate for a golf club head, comprising:

providing a rolled sheet material having an initial thickness, the material having a density of at least 4 g/cc;

forming a blank having a prescribed outer shape from the material; and machining a second side of the blank such that the resulting face plate has a first thickness less than the initial thickness, a second thickness at substantially a center of the face plate, the second thickness less than the first thickness, and a third thickness at least at toe and heel zones of the face plate, the third thickness less than the second thickness;

wherein the machining is performed over a substantial area of the second side.

7. A method as defined in claim 6, wherein the machining is performed by a lathe and the resulting face plate has an axisymmetric thickness variation.

8. A method as defined in claim 6, wherein the machining step includes forming transition regions between regions of first and second thicknesses and between regions first and third thicknesses.

9. A method as defined in claim 6, further comprising machining a bulge and a roll on a first side.

10. A method as defined in claim 6, wherein the machining step is performed with a milling machine, wherein the resulting face plate has a thickness variation that is asymmetric about an axis in a heel to toe direction and has a zone of the first thickness oriented vertically.

11. A method as defined in claim 10, wherein the machining step includes forming webbed transition regions, a radius of the webs matching a profiled cutter of the milling machine.

12. A method as defined in claim 11, wherein the machining step includes forming the toe and heal zones of the third thickness in three or less passes of the profiled cutter.

13. A method as defined in claim 12, further comprising providing three or less profiled cutters, wherein the total number of actions performed by the milling machine is eight or less.

14. A method as defined in claim 10, wherein the vertical zone of the first thickness extends horizontally at least partially in heel and toe directions.

15. A method as defined in claim 6, wherein the second thickness is machined to be at least 0.5 mm less than the first thickness and the third thickness is machined to be at least 1.0 mm less than the first thickness.

16. A method as defined in claim 6, further comprising the step of forming a bulge and roll before the step of the machining the second side.

17. A method as defined in claim 6, further comprising the step of forming a bulge and roll after the step of the machining the second side.

18. A method for manufacturing a face plate for a golf club head, comprising:

providing a rolled sheet of titanium alloy material having an initial thickness;

forming a blank having a prescribed outer shape from the material;

affixing the blank to a CNC machine; and machining a second side of the blank such that the resulting face plate has a first thickness less than the initial thickness, a second thickness at substantially a center of the face plate, the second thickness less than the first thickness, and a third thickness at least at toe and heel zones of the face plate, the third thickness less than the second thickness;

wherein the machining is performed over a substantial area of the second side.

19. A method as defined in claim 18, wherein the machining is performed over at least 70% of the surface area.

20. A method as defined in claim 18, wherein the machining removes at least 15% of the material from the blank.

21. A method for manufacturing a face for a golf club head, comprising:

providing a sheet material having an initial thickness, said material having a density of at least 4 g/cc;

forming a blank having a prescribed outer shape from said material, said blank having a surface area and an initial volume of material; and machining a side of said blank such that said face has a first thickness less than said initial thickness and a second thickness less than said first thickness, said second thickness located at least near one of a toe end and a heel end of said head;

wherein said machining is performed over at least 70% of said surface area and at least 25% of said initial volume of material is removed.

22. A method as defined in claim 21, wherein said machining is performed over at least 80% of said surface area of said blank.

23. A method as defined in claim 21, wherein said material is a rolled sheet of titanium alloy.

24. A method as defined in claim 21, wherein said material is a rolled sheet of steel alloy.

25. A method as defined in claim 21, wherein a resulting face thickness variation is axisymmetric.

26. A method as defined in claim 21, wherein a resulting face thickness variation is asymmetric.

27. A method as defined in claim 21, wherein said face is for an iron-type golf club head.

28. A method as defined in claim 21, wherein said face is for a wood-type golf club head.

29. A method as defined in claim 28, wherein a bulge and roll are formed on a side of said blank.

30. A method as defined in claim 21, wherein said face is substantially flat and welded along a periphery to an opening in a body of said golf club head.

* * * * *